US008082056B2

(12) United States Patent
Schulze

(10) Patent No.: US 8,082,056 B2
(45) Date of Patent: Dec. 20, 2011

(54) OPERATION METHOD FOR A LOOPING PIT WITH DRAG COMPENSATION

(75) Inventor: Bertram Schulze, Hausen (DE)

(73) Assignee: Siemens Aktiengesellschaft, Munich (DE)

( * ) Notice: Subject to any disclaimer, the term of this patent is extended or adjusted under 35 U.S.C. 154(b) by 340 days.

(21) Appl. No.: 12/374,751

(22) PCT Filed: Jun. 26, 2007

(86) PCT No.: PCT/EP2007/056335

§ 371 (c)(1),
(2), (4) Date: Jan. 22, 2009

(87) PCT Pub. No.: WO2008/012154

PCT Pub. Date: Jan. 31, 2008

(65) Prior Publication Data

US 2010/0138036 A1 Jun. 3, 2010

(30) Foreign Application Priority Data

Jul. 28, 2006 (DE) ..... 10 2006 035 008

(51) Int. Cl.
*G06F 19/00* (2011.01)

(52) U.S. Cl. ..... 700/122; 700/170; 226/15; 226/24; 226/25; 242/417.2; 242/418.1

(58) Field of Classification Search ..... 700/122, 700/170; 226/15, 24, 45; 242/417.2, 418.1
See application file for complete search history.

(56) References Cited

U.S. PATENT DOCUMENTS

| | | | | |
|---|---|---|---|---|
| 4,347,723 | A * | 9/1982 | Bradlee | 72/130 |
| 4,516,736 | A * | 5/1985 | Andersen | 242/523 |
| 4,915,282 | A | 4/1990 | Martin et al. | 226/119 |
| 6,856,850 | B2 * | 2/2005 | Rajala et al. | 700/122 |
| 6,964,392 | B1 * | 11/2005 | Matsunaga | 242/419.4 |
| 2003/0230663 | A1 * | 12/2003 | Douaud | 242/417 |
| 2004/0118892 | A1 * | 6/2004 | Weber et al. | 226/44 |
| 2006/0010679 | A1 * | 1/2006 | Hohenbichler et al. | 29/527.7 |

FOREIGN PATENT DOCUMENTS

| | | |
|---|---|---|
| DE | 3731350 | 9/1987 |
| EP | 0425715 | 5/1991 |

OTHER PUBLICATIONS

"Flatness in coil processing operations: New turns in process", Eric Theis, thefabricator.com, Aug. 16, 2001.*
International Search Report; PCT/EP2007/056335; pp. 5, Nov. 22, 2007.

* cited by examiner

*Primary Examiner* — Michael D Masinick
(74) *Attorney, Agent, or Firm* — King & Spalding L.L.P.

(57) ABSTRACT

A band is introduced into the pit entrance of a looping pit. This band is released from the looping pit at a pit exit. A segment of the band can thereby be buffered. The entrance-sided drag that exists in the band at the pit entrance is measured by an entrance-sided drag measuring device; the exit-sided drag that exists in the band at the pit exit is measured by an exit-sided drag measuring device. The values of the entrance-sided and exit-sided drags are passed to a control device. Depending on the entrance-sided and exit-sided drags, a control signal for at least one driven roller arranged between the pit entrance and exit is identified by the control device and is passed to the at least one driven roller. The band buffered in the looping pit is acted upon by the at least one driven roller according to the control signal.

20 Claims, 3 Drawing Sheets v1
2
9
Z1
δZ*,Z*,v1,v2
7
14
δh*
δhi*
4
8
6
5
m*
n*
1
3
10
v2
Z2
δh*,δhi*
Control
11
13
12

OPERATION METHOD FOR A LOOPING PIT WITH DRAG COMPENSATION

CROSS-REFERENCE TO RELATED APPLICATIONS

This application is a U.S. National Stage Application of International Application No. PCT/EP2007/056335 filed Jun. 26, 2007, which designates the United States of America, and claims priority to German Application No. 10 2006 035 008.1 filed Jul. 28, 2006, the contents of which are hereby incorporated by reference in their entirety.

TECHNICAL FIELD

The present invention relates to an operating method for a looping pit by means of which a section of a strip can be buffered. The invention also relates to a data storage medium having a control program, which is stored on the data storage medium, for carrying out an operating method such as this. Finally, the present invention relates to a looping pit, by means of which a section of a strip can be buffered.

BACKGROUND

Looping pits and operating methods for looping pits are generally known. In the prior art, the strip is supplied to the looping pit at a pit entrance. The strip is emitted from the looping pit at a pit exit. The drag in the strip is detected by means of a drag measurement device. The drag measurement device may alternatively be arranged at the pit entrance or at the pit exit. The detected drag is supplied to a control device. The control device readjusts a pit state of the looping pit on the basis of the detected drag.

The looping pit may also have driven rollers which are arranged between the pit entrance and the pit exit. The control device can determine control signals for these rollers, and can emit these control signals to the driven rollers. The driven rollers in this case act on the strip which is buffered in the looping pit, corresponding to the control signals.

Looping pits for strips generally have a multiplicity of rollers, wherein the strip loops alternately around the upper side and the lower side of the rollers, from one roller to another. The heights of the rollers can be adjusted with respect to one another. The length of the strip section which is buffered by the looping pit can be varied by adjusting the vertical distance between the rollers. The vertical distance is normally adjusted by moment control or speed control as a function of a nominal filling level of the looping pit. If driven rollers are driven between the pit entrance and the pit exit, the rollers are subject to individual moment control or speed control as a function of the moment or speed nominal value with which the vertical distance is set and as a function of an entrance speed and/or an exit speed at which the strip is supplied to and emitted from the looping pit.

If the moment or the speed by means of which the vertical distance between the rollers is set is set incorrectly, this incorrect setting influences the drag in the strip section which is located in the looping pit. Drag influences such as these can have negative effects on devices which are arranged downstream from the looping pit. In the prior art, in order to avoid drag fluctuations, the drag is detected—for example on the exit side—and is supplied to the control device. The control device corrects the vertical adjustment speed as a function of the detected drag.

The looping pit according to the prior art already operates quite well. However, its method of operation can be improved.

SUMMARY

According to various embodiment, an operating method can be provided which has been improved in this way for a looping pit. Corresponding data storage medium with the corresponding control program, and a designed looping pit May also be provided according to further embodiments.

According to an embodiment, an operating method for a looping pit by means of which a section of a strip can be buffered, may comprise the steps of: supplying the strip to the looping pit at a pit entrance and emitting the strip from the looping pit at a pit exit, detecting entrance-side drag, which occurs in the strip at the pit entrance by means of an entrance-side drag measurement device, and detecting exit-side drag which occurs in the strip at the pit exit by means of an exit-side drag measurement device, supplying the entrance-side drag and the exit-side drag to a control device, and determining a control signal by the control device for at least one driven roller, which is arranged between the pit entrance and the pit exit, as a function of the entrance-side drag and the exit-side drag, and emitting the control signal to the at least one driven roller, wherein the at least one driven roller acts on the strip which is buffered in the looping pit, corresponding to the control signal, and wherein the control signal is determined by the control device such that a drag difference between the entrance-side drag and the exit-side drag is guided in the direction of a nominal drag difference.

According to a further embodiment, the magnitude of the nominal drag difference can be considerably less than the entrance-side drag and the exit-side drag. According to a further embodiment, the nominal drag difference may have the value zero. According to a further embodiment, non-driven rollers can be provided in addition to the at least one driven roller between the pit entrance and the pit exit, and the number of non-driven rollers is greater than the number of driven rollers. According to a further embodiment, the number of driven rollers can be at least three, and an equal number of non-driven rollers can be arranged between each two driven rollers. According to a further embodiment, the looping pit may have a plurality of sequentially successive pit sections, a specific nominal filling level may be predetermined for each pit section, and each pit section can be operated such that an actual filling level of the respective pit section approaches the corresponding nominal filling level. According to a further embodiment, at least one driven roller may be in each case arranged in at least two of the pit sections, a respective control signal may be determined by the control device for each driven roller as a function of the entrance-side drag and the exit-side drag, and may be emitted to the respective driven roller, and each driven roller may act on the strip which is buffered in the looping pit, corresponding to the respective control signal.

According to another embodiment, a computer readable data storage medium storing a control program, which when executed on a computer may result in a control device for a looping pit receiving an entrance-side drag and an exit-side drag, determines a control signal for at least one driven roller as a function of the entrance-side drag and the exit-side drag, and emits the control signal to the at least one driven roller if the control program is being run by the control device, wherein the control signal is determined by the control device such that a drag difference between the entrance-side drag and the exit-side drag is guided in the direction of a nominal drag difference.

According to yet another embodiment, a looping pit, by means of which a section of a strip can be buffered, may comprise a pit entrance at which the strip can be supplied to the looping pit,—a pit exit via which the strip can be emitted from the looping pit, at least one driven roller, which is arranged between the pit entrance and the pit exit, an entrance-side drag measurement device and an exit-side drag measurement device, by means of which the entrance-side drag which occurs in the strip at the pit entrance, and the exit-side drag which occurs in the strip at the pit exit can be detected, a control device to which the entrance-side drag and the exit-side drag can be supplied, wherein the control device is designed such that a control signal for the at least one driven roller can be determined by it as a function of the entrance-side drag and the exit-side drag, and can be emitted to the at least one driven roller, wherein the at least one driven roller acts on the strip which is buffered in the looping pit, corresponding to the control signal, and wherein the control device is designed such that the control signal can be determined by it such that a drag difference between the entrance-side drag and the exit-side drag is guided in the direction of a nominal drag difference.

According to a further embodiment, the control device may be designed such that the magnitude of the nominal drag difference is considerably less than the entrance-side drag and the exit-side drag. According to a further embodiment, the control device may be designed such that the nominal drag difference has the value zero. According to a further embodiment, non-driven rollers can be provided in addition to the at least one driven roller between the pit entrance and the pit exit, and the number of non-driven rollers is greater than the number of driven rollers. According to a further embodiment, the number of driven rollers may be at least three, and an equal number of non-driven rollers can be arranged between each two driven rollers. According to a further embodiment, the looping pit may have a plurality of sequentially successive pit sections, the control device may be designed such that a specific nominal filling level can be predetermined for each pit section, and each pit section can be operated such that an actual filling level of the respective pit section approaches the corresponding nominal filling level. According to a further embodiment, at least one driven roller may in each case be arranged in at least two of the pit sections, the control device may be designed such that a respective control signal can be determined by the control device for each driven roller as a function of the entrance-side drag and the exit-side drag, and can be emitted to the respective driven roller, and each driven roller may act on the strip which is buffered in the looping pit, corresponding to the respective control signal.

BRIEF DESCRIPTION OF THE DRAWINGS

Further advantages and details will become evident from the following description of the exemplary embodiments and in conjunction with the drawings, in which, illustrated in outline form.

DETAILED DESCRIPTION

Figure 1:
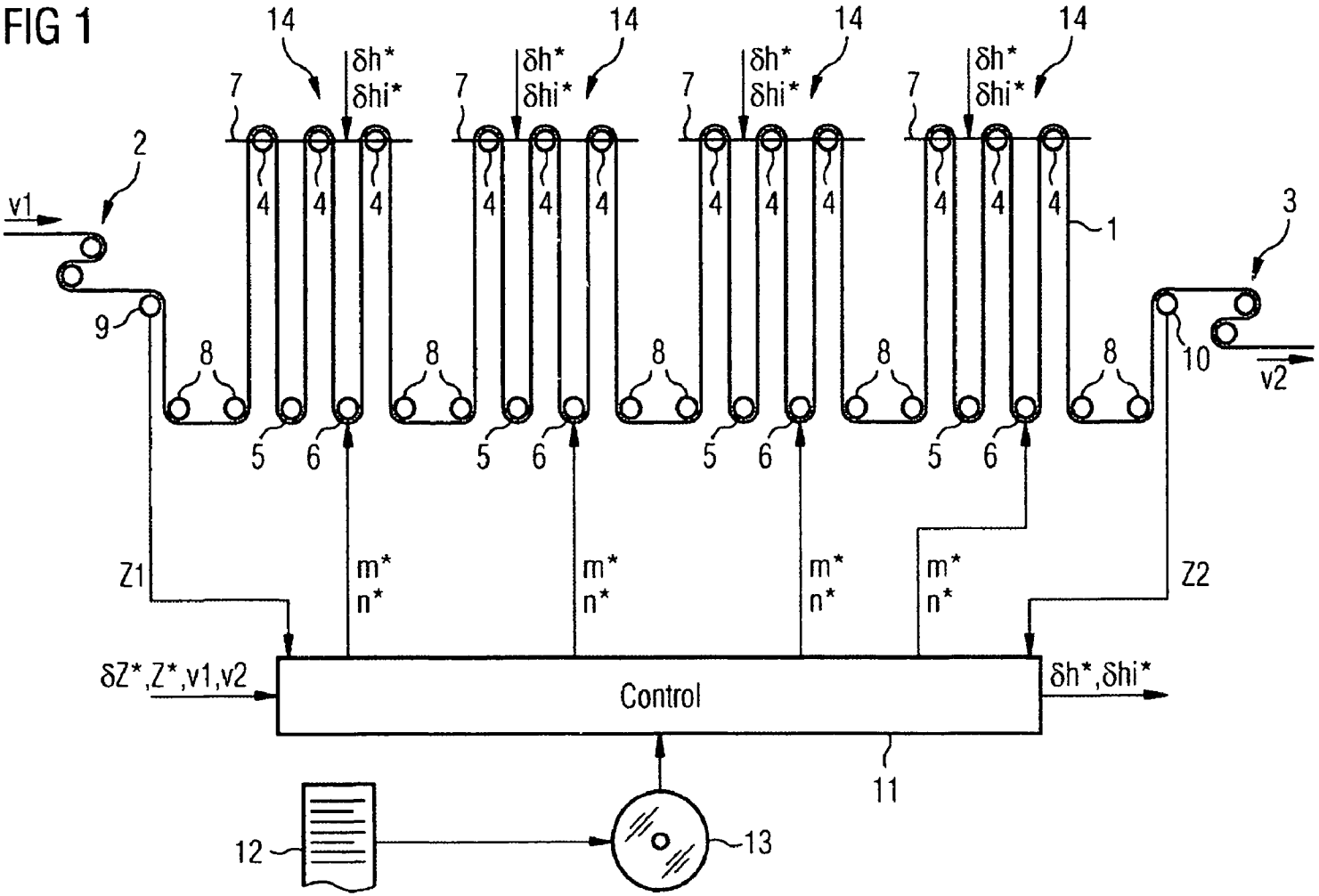
FIG. 1 shows a block diagram of a looping pit.

According to various embodiments, both the entrance-side drag and the exit-side drag are detected by means of appropriate drag measurement devices and are supplied to the control device. The control device determines a control signal for at least one driven roller, which is arranged between the pit entrance and the pit exit, as a function of the entrance-side drag and the exit-side drag, and emits this control signal to the at least one driven roller. The at least one driven roller acts on the strip which is buffered in the looping pit, corresponding to the control signal.

As a result of these measures, the drag in the strip which is buffered in the looping pit has a defined profile from the pit entrance to the pit exit.

The control device preferably may determine the control signal such that a drag difference between the entrance-side drag and the exit-side drag is guided in the direction of a nominal drag difference. This procedure results in the control signal being determined relatively easily.

The magnitude of the nominal drag difference may be preferably considerably less than the entrance-side drag and the exit-side drag. As a result of this measure, the drag in the strip which is located in the looping pit is essentially uniform. The nominal drag difference preferably even may have the value zero.

In general, non-driven rollers are provided between the pit entrance and the pit exit in addition to the at least one driven roller. The number of non-driven rollers can be preferably greater than the number of driven rollers. In particular, this measure allows the control-engineering complexity as well as the design complexity to be kept minimal.

If the number of driven rollers is at least three, an equal number of non-driven rollers can be preferably arranged between each two driven rollers. This measure results in drag being applied uniformly to the strip. Furthermore, this measure makes it easier to determine the control signals.

It is possible for the looping pit to have a plurality of sequentially successive pit sections. In this case, a specific nominal filling level may be preset for each pit section, and each pit section may be operated such that an actual filling level of the respective pit section approaches the corresponding nominal filling level. This measure allows the looping pit to be operated more flexibly.

When a plurality of sequentially successive pit sections is provided, at least one driven roller may preferably in each case be arranged in at least two of the pit sections. In this case, a respective control signal is determined by the control device for each driven roller as a function of the entrance-side drag and the exit-side drag, and is emitted to the respective driven roller. Each driven roller acts on the strip which is buffered in the looping pit, corresponding to the respective control signal. Despite the mutually independent filling levels of the individual pit sections, the driven rollers are in this case controlled such that the drag in the strip is set as desired.

FIG. 1 shows, schematically, the configuration of a looping pit by means of which a section of a strip 1 can be buffered. The looping pit has a pit entrance 2 at which the strip 1 can be supplied to the looping pit. The strip 1 is supplied at an entrance speed v1. The pit entrance 1 may, for example, be in the form of a S-roller as shown in FIG. 1.

The looping pit furthermore has a pit exit 3 via which the strip 1 can be emitted from the looping pit. The strip 1 is emitted at an exit speed v2. The pit exit 3 may, for example, be in the form of an S-roller 3—in the same way as the pit entrance 2.

A multiplicity of upper rollers 4 and lower rollers 5, 6 are arranged between the pit entrance 2 and the pit exit 3. The lower rollers 5, 6 are generally arranged in fixed positions. At least one of the lower rollers 5, 6—in this case the rollers annotated with the reference symbol 6—is or are driven.

The upper rollers 4 are in general arranged in crossmembers 7. The crossmembers 7 can be raised and lowered. The actual filling level of the looping pit (that is to say, overall, the length of the strip 1 which is buffered in the looping pit) can be set by raising or lowering the crossmembers 7.

The looping pit furthermore has guide rollers 8 which can be tilted. The lateral movement of the strip 1 can be influenced, and in particular can be prevented and/or corrected, by means of the guide rollers 8.

Furthermore, the looping pit has an entrance-side drag measurement device 9 and an exit-side drag measurement device 10. The entrance-side drag Z1 which occurs in the strip 1 at the pit entrance 2 can be measured by means of the entrance-side drag measurement device 9. The output-side drag Z2 which occurs in the strip 1 at the pit exit 3 can be detected by means of the exit-side drag measurement device 10.

Finally, the looping pit has a control device 11 which is programmed by means of a control program 12. The control program 12 is stored in exclusively machine-legible form on a data storage medium 13 (for example a CD-ROM 13). The control program 12 is supplied to the control device 11 by means of the data storage medium 13, and the control device 11 is thus programmed.

On the basis of the programming with the control program 12, the control device 11 operates the looping pit in accordance with an operating procedure which will be explained in more detail in the following text in conjunction with FIG. 2. Reference is additionally made to FIG. 1.

Figure 2:
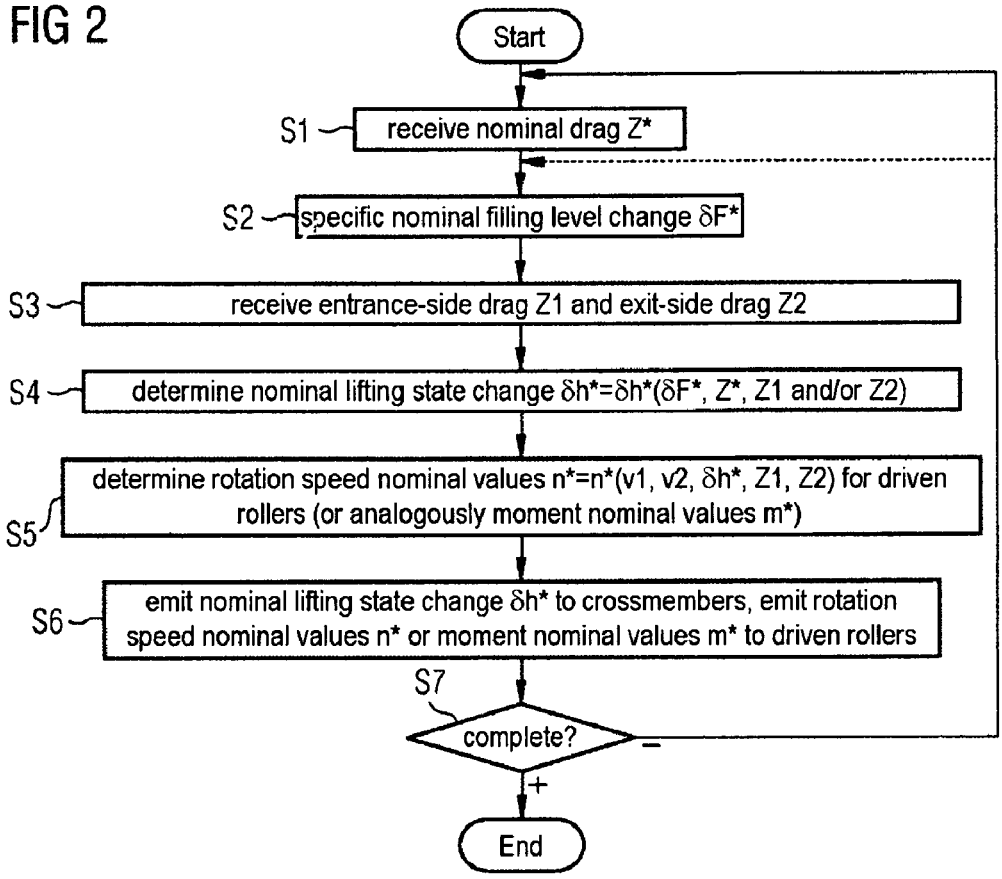
FIGS. 2 to 5 show flow charts.

As shown in FIG. 2, the control device 11 receives a nominal drag Z* in a step S1. For example, an operator, who is not illustrated in FIG. 1, of the control device 11 can preset the nominal drag Z*. The nominal drag Z* may alternatively be preset in a fixed manner by the control program 12. As a further alternative, it is possible for the nominal drag Z* to be determined by external circumstances (for example the operating state of an installation following the looping pit). For the purposes of the present invention, the way in which the nominal drag Z* is set is irrelevant.

In a step S2, the control device 11 determines a change δF* of a nominal filling level of the looping pit. In general, the control device 11 determines the nominal filling level change δF* on the basis of a clock with which it operates, in conjunction with the entrance speed v1 and the exit speed v2.

In a step S3, the control device 11 receives the drags Z1, Z2, which are detected by the drag measurement devices 9, 10, from the drag measurement devices 9, 10.

In a step S4, the control device 11 determines a nominal lifting state change δh* for the crossmembers 7. It determines the nominal lifting state change δh* as a function of the nominal filling level change δF*, the nominal drag Z* and at least one of the two drags Z1, Z2. The nominal lifting state change δh* may, in particular, correspond to a moment nominal value or a speed nominal value. The step S4 will be explained in more detail later, in conjunction with FIG. 3.

In a step S5, the control device 11 determines a moment nominal value m* or a rotation speed nominal value n* for each driven lower roller 6. It determines the nominal values m*, n* as a function of the position of the respective driven lower roller 6 in the looping pit, the entrance speed v1, the exit speed v2, the nominal lifting state change δh* and the two drags Z1, Z2. The step S5 will be explained in more detail in conjunction with FIG. 4.

In a step S6, the control device 11 emits the nominal lifting state change δh* to the crossmembers 7. It also, in the course of step S6, emits the nominal values m*, n* to the driven rollers 6. The nominal values m*, n* correspond to control signals for the purposes of the present invention.

The crossmembers 7 are adjusted appropriately on the basis of the predetermined nominal lifting state change δh*. The actual filling level of the looping pit is thus adjusted corresponding to the determined nominal filling level change δF*. The actual filling level of the looping pit at least approaches the corresponding nominal filling level.

In the same way, the driven rollers 6 act on the strip 1, which is buffered in the looping pit, corresponding to the nominal values m*, n*.

In a step S7, the control device 11 checks whether the control of the looping pit should be ended. If this is the case, (for example because the looping pit is stationary), the method shown in FIG. 2 is ended. Otherwise, the control device 11 returns to step S1 or to step S2.

Figure 3:
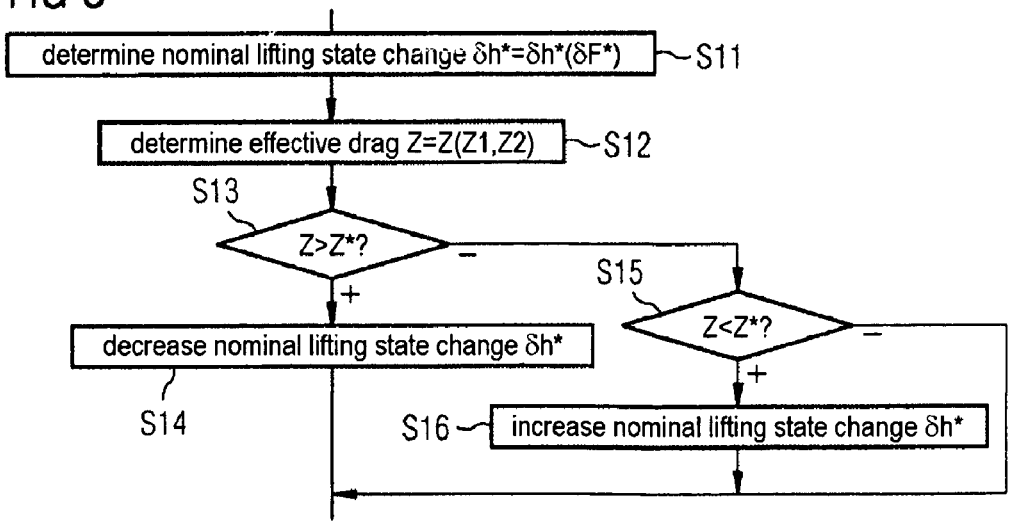

Various procedures are possible for implementation of step S4 from FIG. 2. For example, it is thus possible to configure the step S4 as an intrinsically closed, standard determination process. The following procedure is preferred, as shown in FIG. 3:

In a step S11, the control device 11 first of all determines the nominal lifting state change δh* as a function of the nominal filling level change δF*. Furthermore, in a step S12, the control device 11 uses the entrance-side drag Z1 and/or the exit-side drag Z2 to determine an effective drag Z. For example, the control device 11 can accept one of the two drags Z1, Z2 as the effective drag Z. Alternatively, the control device 11 could, for example, determine the mean value of the two drags Z1, Z2.

In a step S13, the control device 11 checks whether the effective drag Z is greater than the nominal drag Z*. If this is the case, in a step S14, the control device 11 decreases the nominal lifting state change δh* by a correction value which is dependent on the difference between the effective drag Z and the nominal drag Z*.

If the effective drag Z is not greater than the nominal drag Z*, the control device 11 checks, in a step S15, whether the effective drag Z is less than the nominal drag Z*. If this is the case, in a step S16, the control device 11 increases the nominal lifting state change δh* by a correction value which is dependent on the difference between the effective drag Z and the nominal drag Z*.

As can be seen from FIG. 3, the nominal lifting state change δh* is determined essentially by the nominal filling level change δF*. However, this also depends, if only to a minor extent, on the discrepancy between effective drag Z and the nominal drag Z*.

Figure 4:
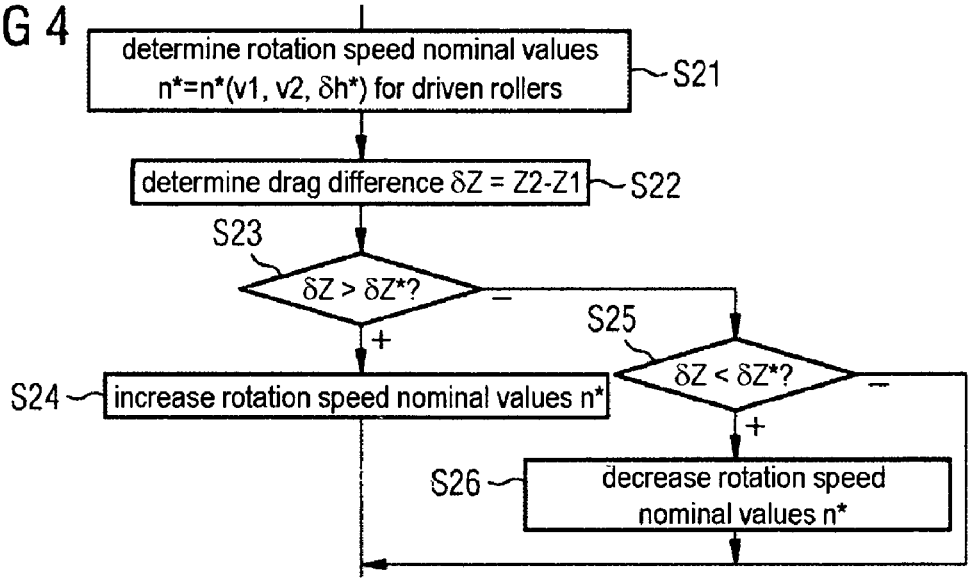

In a similar manner, with reference to the step S5, it is also possible to implement step S5 as a standard step. However, the following procedure is preferred, as shown in FIG. 4:

In step S21, the control device 11 determines the rotation speed nominal values n* for the driven rollers 6 as a function of the entrance speed v1, the exit speed v2 and the nominal lifting state change δh*.

In a step S22, the control device 11 uses the exit-side drag Z2 and the entrance-side drag Z1 to determine a drag difference δZ.

In a step S23, the control device 11 checks whether the drag difference δZ is greater than a nominal drag difference δZ*. If this is the case, in a step S24, the control device 11 increases the rotation speed nominal values n* for the driven rollers 6.

If the drag difference δZ is not greater than the nominal drag difference δZ*, the control device 11 checks, in a step S25, whether the drag difference δZ* is less than the nominal drag difference δZ*. If this is the case, in a step S26, the control device 11 decreases the rotation speed nominal values n* for the driven rollers 6.

As can be seen from FIG. 4, the rotation speed nominal values n* are determined essentially by the speeds v1, v2 and the nominal lifting state change δh*. However, if only to a minor extent, they also depend on the drags Z1 and Z2. In particular, they depend on whether the drag difference δZ is greater than or less than the nominal drag difference δZ*. In both cases, the rotation speed nominal values n* of the driven rollers 6 are corrected such that the drag difference δZ is guided in the direction of the nominal drag difference δZ*.

The procedure which has been described above in conjunction with FIG. 4 can be implemented analogously if the aim is to determine moment nominal values m* instead of the rotation speed nominal values n*.

The nominal drag difference δZ* may in principle have any desired value. The magnitude of the nominal drag difference δZ* is preferably considerably less than the entrance-side drag Z1 and the exit-side drag Z2. In particular, the nominal drag difference δZ* may have the value zero.

It is possible for all the rollers 4, 5, 6 to be driven. In general, at least the upper rollers 4 are not driven. In addition to the driven rollers 6, there are therefore non-driven rollers 4, 5 between the pit entrance 2 and the pit exit 3.

It is also possible for all the lower rollers 5, 6 to be driven. However, as shown in FIG. 1, any some of the lower rollers 5, 6 are driven, specifically the driven lower rollers with the reference symbol 6. Overall, the number of non-driven rollers 4, 5 is therefore greater than the number of driven rollers 6.

If the rollers 4, 5, 6 are not all driven, the driven rollers 6 are in general distributed arbitrarily between the pit entrance and the pit exit 3. In principle, there may also be any desired number of driven rollers 6.

In general, the number of driven rollers 6 is greater than two. It is therefore at least three. As shown in FIG. 1 even four driven rollers 6 are provided. As shown in FIG. 1, the same number of non-driven rollers 4, 5 are also arranged between each two driven rollers 6. The last statement is preferably true irrespective of whether the guide rollers 8 are also counted as non-driven rollers in addition to the upper rollers 4 and the non-driven lower rollers 5.

It is possible for the looping pit to always be operated in a standard manner. For example, the looping pit may have just one single crossmember 7. Standard operation is also possible in the refinement shown in FIG. 1, in which there are a plurality of crossmembers 7. In this case, all the crossmembers 7 must always be driven in the same way.

Each crossmember 7 defines a pit section 14, in which the pit sections 14 are sequentially successive. In an appropriate refinement of the control device 11, it is possible for the individual pit sections 14 to be operated independently of one another. This will be explained in more detail in the following text, in conjunction with FIG. 5.

Figure 5:
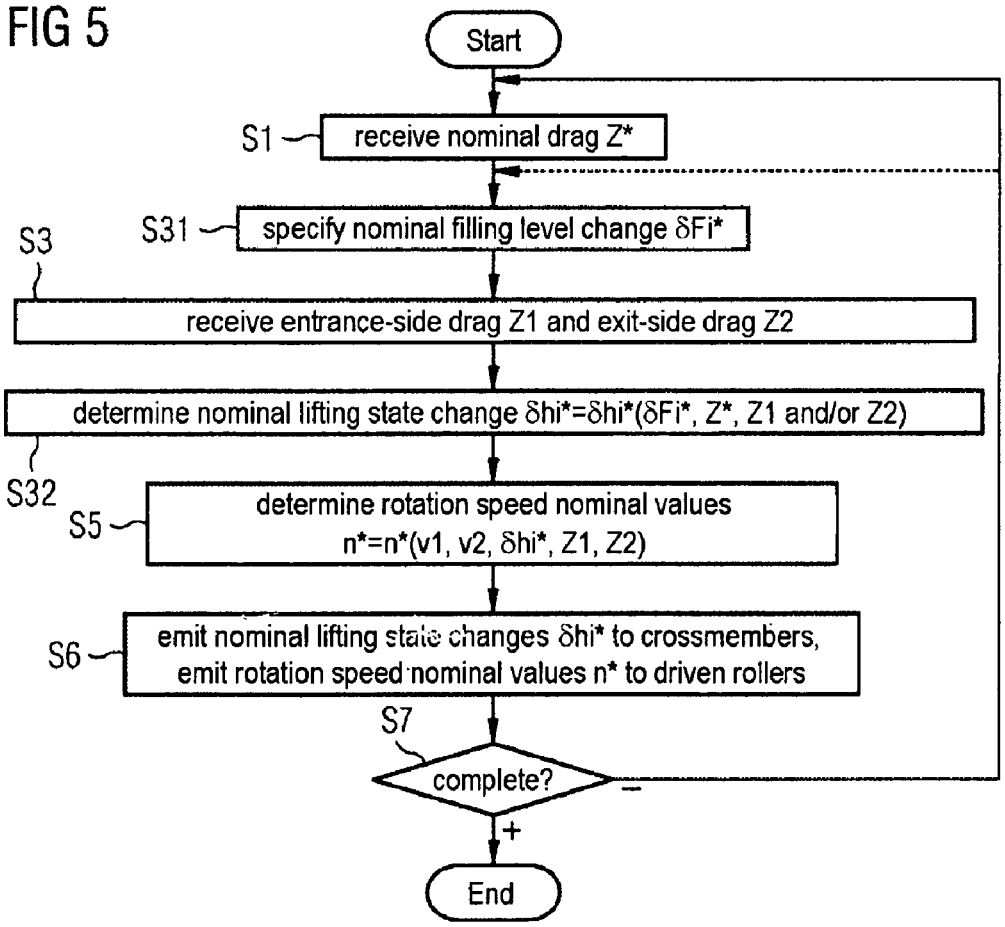

FIG. 5 shows the same basic configuration as FIG. 2. Only the differences from FIG. 2 will therefore be described in more detail in the following text.

As shown in FIG. 5, the step S2 is replaced by a step S31. In step S31, the control device 11 determines a specific nominal filling level change δFi* (i represents an index of the respective pit section 14) for each pit section 14. The determination of the nominal filling level changes δFi* is known per se. For example, individual ones of the pit sections 14 can be deactivated in such a way that they are operated with a constant filling level of 50%.

Furthermore, as shown in FIG. 5, the step S4 is replaced by a step S32. In step S32, the control device 11 determines a nominal lifting state change δhi* individually for each pit section 14. In this case as well, the index i represents the respective pit section 14. The respective nominal lifting state change δhi* is emitted individually to each pit section 14. Each pit section 14 is therefore operated such that the actual filling level of the respective pit section 14 approaches the corresponding nominal filling level.

In contrast, the step S5 is retained in the refinement shown in FIG. 5. In the refinement in FIG. 5, the control device 11 therefore also determines a corresponding moment or rotation speed nominal value m*, n* for each driven roller 6 as a function of the entrance-side drag Z1 and the exit-side drag Z2, and emits this to the respective driven roller 6. Each driven roller 6 therefore acts on the strip 1 which is buffered in the looping pit, corresponding to the respective nominal value m*, n*. This statement is still true even though the driven rollers 6 are distributed over the pit sections 14 and nominal lifting state changes δhi* which differ from one another are preset for the pit sections 14. The only difference is that, in the course of step S32, the nominal lifting state change δhi* of the pit section 14 in which the respective driven roller 6 is arranged is taken into account for determining the rotation speed nominal values n* for each driven roller 6.

The various embodiments allow the looping pit to be operated in a better manner than that in the prior art, in a simple manner. Since, furthermore, the exit-side drag Z2 is also detected in the case of looping pits according to the prior art, and even the entrance-side drag is also detected in some looping pits, all that is necessary for retrofitting purposes is to adapt the control program 12 of the control device 11, possibly in addition to retrofitting of the entrance-side drag measurement device 9.

The above description is intended exclusively to explain the present invention. The scope of protection of the present invention is in contrast intended to be determined exclusively by the attached claims.

What is claimed is:

1. An operating method for a looping pit by means of which a section of a strip can be buffered, comprising the steps of:

supplying the strip to the looping pit at a pit entrance and emitting the strip from the looping pit at a pit exit, detecting entrance-side drag, which occurs in the strip at the pit entrance by means of an entrance-side drag measurement device, and detecting exit-side drag which occurs in the strip at the pit exit by means of an exit-side drag measurement device, supplying the entrance-side drag and the exit-side drag to a control device, comparing the entrance-side drag and the exit-side drag to calculate a drag difference between the entrance-side drag and the exit-side drag, comparing the calculated drag difference to a nominal drag difference, and determining a control signal by the control device for at least one driven roller, which is arranged between the pit entrance and the pit exit, as a function of the comparison of the calculated drag difference to the nominal drag difference, and emitting the control signal to the at least one driven roller, wherein the at least one driven roller acts on the strip which is buffered in the looping pit, corresponding to the control signal.

2. The operating method according to claim 1, wherein the magnitude of the nominal drag difference is considerably less than the entrance-side drag and the exit-side drag.

3. The operating method according to claim 2, wherein the nominal drag difference has the value zero.

4. The operating method according to claim 1, wherein non-driven rollers are provided in addition to the at least one driven roller between the pit entrance and the pit exit, and the number of non-driven rollers is greater than the number of driven rollers.

5. The operating method according to claim 4, wherein the number of driven rollers is at least three, and an equal number of non-driven rollers are arranged between each two driven rollers.

6. The operating method according to claim 1, wherein the looping pit has a plurality of sequentially successive pit sections, a specific nominal filling level is predetermined for each pit section, and each pit section is operated such that an actual filling level of the respective pit section approaches the corresponding nominal filling level.

7. The operating method according to claim 6, wherein at least one driven roller is in each case arranged in at least two of the pit sections, a respective control signal is determined by the control device for each driven roller as a function of the entrance-side drag and the exit-side drag, and is emitted to the respective driven roller, and each driven roller acts on the strip which is buffered in the looping pit, corresponding to the respective control signal.

8. A looping pit, by means of which a section of a strip can be buffered, comprising:

a pit entrance at which the strip can be supplied to the looping pit, a pit exit via which the strip can be emitted from the looping pit, at least one driven roller, which is arranged between the pit entrance and the pit exit, an entrance-side drag measurement device and an exit-side drag measurement device, by means of which the entrance-side drag which occurs in the strip at the pit entrance, and the exit-side drag which occurs in the strip at the pit exit can be detected, a control device to which the entrance-side drag and the exit-side drag can be supplied, the control device configured to:

compare the entrance-side drag and the exit-side drag to calculate a drag difference between the entrance-side drag and the exit-side drag, compare the calculated drag difference to a nominal drag difference, and determine a control signal for the at least one driven roller as a function of the results of the comparison of the calculated drag difference to the nominal drag difference, and emit the control signal to the at least one driven roller, wherein the at least one driven roller acts on the strip which is buffered in the looping pit, corresponding to the control signal.

9. The looping pit according to claim 8, wherein the control device is designed such that the magnitude of the nominal drag difference is considerably less than the entrance-side drag and the exit-side drag.

10. The looping pit according to claim 9, wherein the control device is designed such that the nominal drag difference has the value zero.

11. The looping pit according to claim 8, wherein non-driven rollers are provided in addition to the at least one driven roller between the pit entrance and the pit exit, and the number of non-driven rollers is greater than the number of driven rollers.

12. The looping pit according to claim 11, wherein the number of driven rollers is at least three, and an equal number of non-driven rollers are arranged between each two driven rollers.

13. The looping pit according to claim 8, wherein the looping pit has a plurality of sequentially successive pit sections, the control device is designed such that a specific nominal filling level can be predetermined for each pit section, and each pit section can be operated such that an actual filling level of the respective pit section approaches the corresponding nominal filling level.

14. The looping pit according to claim 13, wherein at least one driven roller is in each case arranged in at least two of the pit sections, the control device is designed such that a respective control signal can be determined by the control device for each driven roller as a function of the entrance-side drag and the exit-side drag, and can be emitted to the respective driven roller, and each driven roller acts on the strip which is buffered in the looping pit, corresponding to the respective control signal.

15. A computer readable data storage medium storing a control program, wherein the control program when executed on a computer results in a control device for a looping pit receiving an entrance-side drag and an exit-side drag, determines a control signal for at least one driven roller as a function of the entrance-side drag and the exit-side drag, and emits the control signal to the at least one driven roller if the control program is being run by the control device, wherein the control signal is determined by the control device such that a drag difference between the entrance-side drag and the exit-side drag is guided in the direction of a nominal drag difference.

16. The computer readable data storage medium according to claim 15, wherein the magnitude of the nominal drag difference is considerably less than the entrance-side drag and the exit-side drag.

17. The computer readable data storage medium according to claim 16, wherein the nominal drag difference has the value zero.

18. The computer readable data storage medium according to claim 15, wherein non-driven rollers are provided in addition to the at least one driven roller between the pit entrance and the pit exit, and the number of non-driven rollers is greater than the number of driven rollers.

19. The computer readable data storage medium according to claim 18, wherein the number of driven rollers is at least three, and an equal number of non-driven rollers are arranged between each two driven rollers.

20. The computer readable data storage medium according to claim 15, wherein the looping pit has a plurality of sequentially successive pit sections, a specific nominal filling level is predetermined for each pit section, and each pit section is operated such that an actual filling level of the respective pit section approaches the corresponding nominal filling level.

* * * * *